US007674302B1

(12) United States Patent
Weiner

(10) Patent No.: US 7,674,302 B1
(45) **Date of Patent: *Mar. 9, 2010**

(54) METHOD OF CREATING OLD ART DYEING EFFECT WITH ACID AND CATIONIC DYED CARPET

(75) Inventor: Robert S. Weiner, Atlanta, GA (US)

(73) Assignee: Product Concepts Residential, L.L.C., Dalton, GA (US)

( * ) Notice: Subject to any disclaimer, the term of this patent is extended or adjusted under 35 U.S.C. 154(b) by 99 days.

This patent is subject to a terminal disclaimer.

(21) Appl. No.: 11/749,394

(22) Filed: May 16, 2007

(51) Int. Cl.
*D06P 5/22* (2006.01)
*D06P 5/00* (2006.01)

(52) U.S. Cl. ..... 8/478; 8/479; 8/483

(58) Field of Classification Search ..... 8/636, 8/478, 479, 483; 112/410
See application file for complete search history.

(56) References Cited

U.S. PATENT DOCUMENTS 4,222,223 A * 9/1980 Nelson ..... 57/246
2008/0016625 A1* 1/2008 Rao ..... 8/115.51

FOREIGN PATENT DOCUMENTS

WO WO 0173189 A1 * 10/2001
WO WO 01/73189 A1 * 10/2004

* cited by examiner

*Primary Examiner*—Harold Y Pyon
*Assistant Examiner*—Katie Hammer
(74) *Attorney, Agent, or Firm*—Stephen J. Stark; Miller & Martin PLLC

(57) ABSTRACT

A method of manufacturing carpet provides for an old art dyeing effect. Specifically, acid and cationic dyes are provided in a solution to a carpet tufted with cationic and acid dye fibers. The carpet is preferably tufted in such a way that there is a relative scarcity of one of the cationic and acid dye fibers at a first width. An abundance of the other dye accumulates in higher concentration than in surrounding areas at the first width. This higher concentration tends to diffuse and/or be moved by other mechanisms to the surrounding areas or widths where the dye attaches to appropriate contacts. This creates at least one of the dark band, a fade and/or a old art dye effect at that location. By precisely controlling the carpet fiber location at the upper surface, the dye solution and the dyeing process, fades and other process can be precisely controlled for repeatable performance as has not been experienced in the prior art.

20 Claims, 2 Drawing Sheets

METHOD OF CREATING OLD ART DYEING EFFECT WITH ACID AND CATIONIC DYED CARPET

FIELD OF THE INVENTION

The present invention relates to a method of providing a carpet having an old art dyeing effect wherein a dye bath containing both acid and cationic dyes are utilized with a carpet tufted of both acid and cationic fibers in a specific manner and with a specific treatment to provide an effect of old art dyeing techniques.

BACKGROUND OF THE INVENTION

Acid dyes and cationic dyes have been utilized for many years by carpet manufacturers. Acid dyes are normally referred to as water soluble cationic dyes that are applied to fibers normally using neutral dye acid dye baths. Attachment to the fiber is believed to be attributed at least partly to salt formation between anionic groups and the dyes and cationic groups in the fibers.

Cationic dyes are normally water soluble and may be applied to oppositely charged groups in the fiber to provide salts as well. When utilizing them both together in solution with a carpet tufted with both acid and cationic fibers, anti-precipitants are often utilized in the mixture. This technology has been utilized for many years in the carpet industry principally in the form of a solution containing both acid and cationic dyes which are applied in a beck (something akin to a vat) with carpet run therethrough over a period of time. This normally results in two color colorations (from the two dyes) as is known in the art. Since the dyes are normally in a beck, they are free to flow back and forth and normally provide precise attachment to specific fibers in a desired manner. Carpet manufacturers have been doing this for years.

In an effort to reduce energy expenditures, the applicant has been utilizing a continuous dyeing process for a number of years in which carpet is fed through a single application of dye normally proceeding then through at least one steamer. Location of cationic and acid fibers have been precisely provided so that dyes would not bleed over into locations. Providing first run carpet is a principal object of dyeing operations.

To the applicant's knowledge, no company has intentionally created a carpet providing a fade over at least a few tuft stitches if not over a few inches somewhat akin to an old art dying look. In modern carpet manufacturing techniques such as construction would not be believed to be obvious from current construction methods as it would have appeared as a "second" quality good and discarded for not complying with an intended sample pattern.

SUMMARY OF THE INVENTION

It is an object of the present invention to provide an improved method for manufacturing carpet thereby providing a fade over at least two stitches of carpet tufts if not a few inches, to provide what the applicant would describe as old art dye look.

It is another object of the present invention to provide a method of dyeing carpet to achieve a fade effect such as from dark to light and/or begin with a darker band.

It is another object of the present invention to utilize dyeing in conjunction with tufting to provide a look of a fade across a distance of carpet to soften or otherwise transition from one portion of a carpet design to another.

In accordance with the presently preferred embodiment of the present invention, the applicant is tufting a carpet with both cationic and acid fibers. This in itself is not new. However, the placement of the cationic fibers and the acid fibers relative to one another when coupled with a continuous process for dyeing (and not dyeing in a beck as is done by the majority of companies in the industry), has been found to be able to result in a process for providing repeatable fade effects at specific regions such as where two yarn fiber types meet as the result of the placement of the cationic and acid fibers working in conjunction with the relative absorption of dye from the continuously applied dye process and subsequent post treatment wherein a relative scarcity of one of cationic and acid fibers at a first width results in a relative surplus of that dye type which is then moved and absorbed in adjacent widths of the appropriately charged fiber. In the prior art, fiber placement was precisely controlled to prevent such a situation from occurring.

In the preferred embodiment, a continuous process of dying, dye of both varieties (acid and cationic) is applied in solution onto the fibers over its width as the carpet is continuously proceeding therethrough. The acid fiber dye attaches to the acid fibers while the cationic dye attaches to the cationic fibers. Since there is a relative abundance of one of acid fibers and cationic fibers at a surface of a first width, a relative scarcity of the other of acid and cationic fibers, a tendency occurs for the one of the acid and cationic dye which is in relative abundance to accumulate at that location in higher concentration and potentially diffuse or be moved over to adjacent widths of fibers where the appropriate fiber is then located. By having relatively wide or thick portions of a relative majority of acidic fibers or cationic fibers at an upper surface, the bleeding or movement effect can be achieved in a controlled manner to provide at least one of a fade effect, a darker band, and/or an old art dye effect in the adjacent portions. This effect can be magnified in the feed direction during tufting using a mechanism such as gravity to assist in moving a relative higher concentration of a particular dye in solution to another width. Other mechanisms can be employed to assist in spreading the abundance of relative concentration of dye at a location to other locations such as jets or other effects mechanisms in either the lateral or feed directions.

The applicant has discovered that utilizing this technique with diffusion can result in a fade across at least a couple of tuft rows in a lateral direction with diffusion if not several inches with gravity or mechanical assist, to create what is believed to be a rather unique and desirable effect when properly controlled. In the past this effect would have resulted in a reject and the manufacturer would have taken care to ensure your placement prevented such an effect.

BRIEF DESCRIPTION OF DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
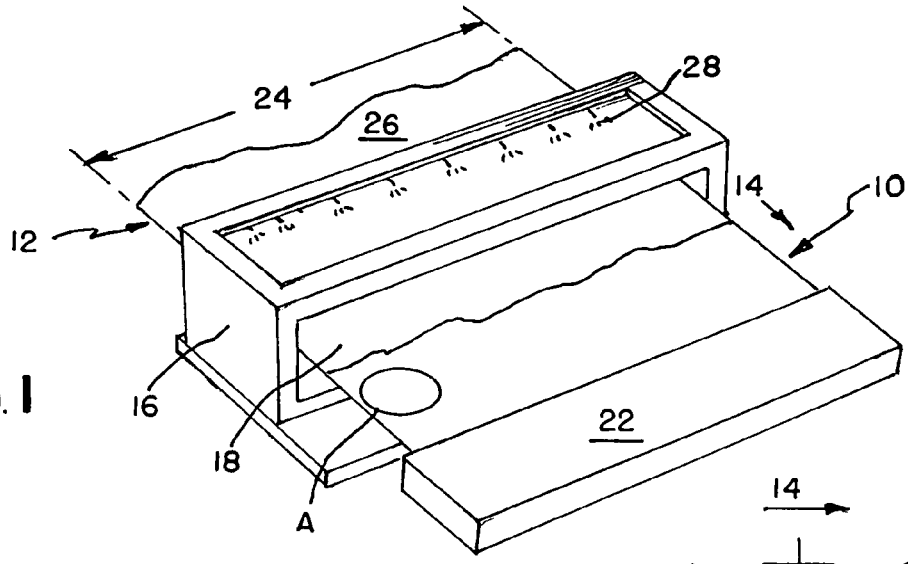
FIG. 1 shows a top perspective view of a continuous dying process in accordance with a presently preferred embodiment of the present invention.

FIG. 1 shows a portion of a continuous dying process in which tufted carpet 12 compromised of at least some cationic fiber and some acid dye fibers are both present in the carpet 12. Carpet 12 is fed in a direction of feed 14 through a dye applicator 16. The dye applicator 16 dispenses a solution 18 of dyes containing both cationic and acid dyes onto and effectively into the carpet 12 where at least some of the solution 18 pools on top (i.e., an upper surface) of the carpet 12 or at least above the backing for at least a short period of time for at least a distance following dye application point or plane 20 shown on FIG. 2. From there the carpet 12 continues on typically through one or more steamers 22 shown in FIG. 1 which may be horizontal and/or vertically oriented steamers and onto further processing steps as are known in the art. Typically carpet rolls can then be provided for such further processing as installation into structures and/or providing into carpet tiles. Portion A is shown in detail in FIG. 6 and will be described in further detail below.

As the tufted carpet 12 passes through the dye applicator 16, it is subjected to a solution 18 of dye starting with contact at approximately application plane or point 20. It need not be a planar contact, but is where the solution 18 begins contact with the carpet 12. Upon contact of the solution 18 with the carpet 12, the individual and appropriate yarn fibers begin to be dyed with cationic and acid dyes contained within the solution 18.

What is different about the applicant's claimed method is that the placement of yarns in the carpet 12 is such that there is a relative abundance of at least one of the cationic and acid dye fibers at a particular location or width 21 such as in lateral direction 24 such as can be created in a number of different ways. First, fiber types can be one of cationic and acid types. One of these two types can be significantly more present towards an upper surface 26 of the carpet 12 at particular locations such as by burying the other of the two type yarns at specific locations or widths or just tufting with one type at a particular location. (i.e., there may just be an absence of a particular yarn at a particular location.) Accordingly, when the solution 18 of dye is provided by the applicator 16 at that location such as from orifices or jets 28, the relative majority of one type of fiber (acid or cationic) does not absorb the other type of dye thereby creating a relative greater connection than in other areas where that dye is attaching to the appropriate fiber.

As it relates the applicant's improved method by selecting providing a scarcity of one type of acid or cationic fibers at a particular location, the relative abundance of the either yarn type will soak up the appropriate dye of more appropriate cationic or acid dye from that particular location. This results in a relative abundance of the opposite dye which then depending on a particular embodiment involved, migrates towards the appropriate yarns in adjacent widths such as across a few yarn stitches 30.

Figure 6:
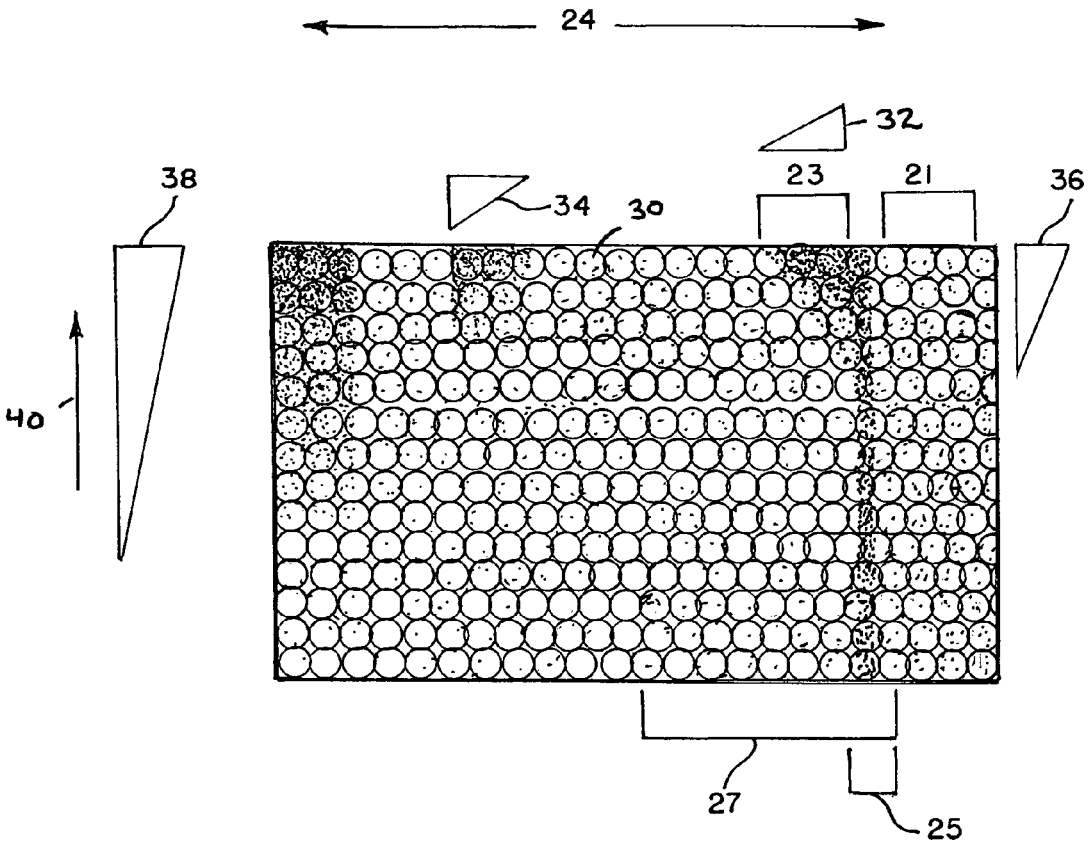
FIG. 6 shows a top plan view of the detail A in FIG. 1 showing a fade effect achieved by the present invention.

FIG. 6 shows yarn tufts 30 with a fade effect created by the higher concentration dye migrating over up to several inches depending on the particular configuration or orientation of the carpet 12 as it proceeds through the dyeing and/or post treatment process.

Cationic or acid dye which is not absorbed at a particular location due to a relative scarcity of the appropriate fabric to attach, provides a higher concentration at a particular width and as a result of diffusion, gravity, or other effect, spreads out into different width (wide widths being referred to in both the lateral and feed directions).

As shown in FIG. 6, the absence of any mechanical movement such as by gravity or with the use of jets, this relative concentration has been found to result in a fade effect over the portion which is receptive to that dye such as a few tuft stitches illustrated by fade 32 over a few yarn tufts 30 as illustrated. A difference in coloration can make this gradual or a quick transition and the triangle 32 represents a coloration fade from a first darker shade to a second lighter shade. It may also result in a darker stripe or band for a portion of the yarn tufts 30. The dark to light transition is often referred to as an old art dye effect.

This particular effect is aesthetically pleasing and can represent old art dye works for certain carpet configurations based on the placement of the specific yarns. Relatively wide portions of predominantly one of cationic or acid dye fibers at the upper service 26 have been found to assist in the effect created. In the prior art this would have been undesirable, as the fade 32 would have given rise to a second quality good. In a precisely controlled scenario, the fade 32 has been found to be desirable and repeatable for at least some carpet designs.

Once a fade 32 was established consistently over a few yarn tufts 30 the applicant began to experiment and discovered by varying the angle of the carpet 12 after the dye application point 22 such as by angling it up a little bit or a lot or even directing it up through a vertically steamer 22. Fade such as fade 34, 36 or even 38 which vary in distance a long length can be achieved from a few yarn tufts up to several inches depending on the angle or relationship of the carpet 12 as it progresses away from the dye application point 20 or rather the applicator 16. As the solution 18 remains on top of the carpet and attaches to specific fibers and/or is affected by gravity or other effects as described below, the length out of the fade 34, 36, 38 can be affected and controlled in the feed direction 40.

It is important to remember that the feed direction 40 is perpendicular to the lateral direction 24. Feed direction 40 is the direction of feed of the carpet. Furthermore, utilizing fades over both or either the feed and lateral directions can be achieved to create a variety of effects not previously accomplished in the carpet industry for reproducible patterns. Widths are described herein for both the lateral and feed direction 40,24.

Figure 2:
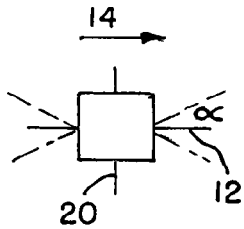
FIG. 2 shows a plan view taken at the dye applicator in FIG. 1 showing multiple relationships of the carpet as it can proceed in the direction of feed with applied dye to provide an effect in accordance with the presently preferred embodiment of the present invention.

An effect of gravity is shown in FIG. 2 and can be magnified by changing the angled to affect the movement of solution 18 and particular dye removed from the solution 18. A relative abundance of a particular dye can be moved to other areas, in the direction of feed or laterally using mechanisms such as mechanical movement with jets or otherwise, gravity and/or diffusion in the direction of feed or otherwise.

Figure 3:
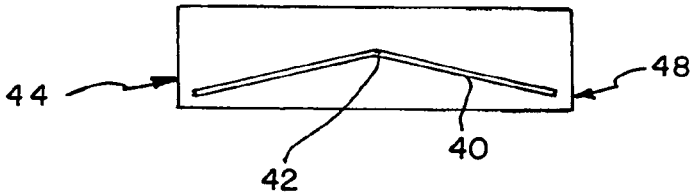
FIG. 3 is a back plan view of the dye applicator showing a back plate sloping away from the center to create a different lateral dye effect of an alternatively preferred embodiment.
Figure 4:
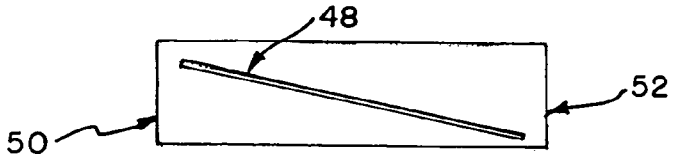
FIG. 4 is a dye applicator in an alternatively preferred embodiment having a slant which would direct dye in a single direction after application.

FIG. 3 shows the dye applicator 16 in FIG. 1 having a back plate 42 which has a peak to somewhere intermediate outer edges 44,46 which would result in solution 18 being directed toward the outer edges 44, 46 of the applicator 16. This would create somewhat of a outward type fade effect represented by fade 32 and may be longer than just a couple of tuft rows. FIG. 4 shows a somewhat similar concept of using gravity to provide fades 32 in a single direction as opposed to two directions by having a peak 48 towards one end 50, thereby directing the solution 18 toward the second end 52 and thereby potentially causing fade effects in that direction.

Figure 5:
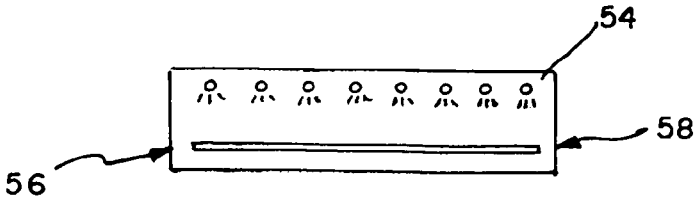
FIG. 5 is a back plan view of a dye applicator of an alternatively preferred embodiment utilizing jets to either direct one of at least dye and air with the application of dye to assist in having dye flow atop the carpet after it passes through the dye applicator in a desired manner to achieve results similar to the embodiment of FIG. 3 or otherwise.

FIG. 5 provides a similar effect as applicator 16 of FIG. 1. Jets 54 which may be different from jets 28 shown in FIG. 1 or angled jets direct dye solution 18 outwardly toward edges 56, 58 to essentially accomplish the same objective as shown where it would be accomplished with gravity in FIG. 3 without a raised bed 40.

FIG. 5 is illustrative in showing that there are other ways to accomplish the desired objective of directing predetermined width dye which has a higher concentration of one of acid and cationic dye in solution 18 from one on the carpet 12 towards adjacent second predetermined widths to assist in creating respective fades such as fade 32, 34, 36 or 38 and/or dark bands and/or old art dyeing effects.

Specifically, FIG. 1 shows a method of tufting a carpet 12 having cationic and acid dye fibers where there is a relative majority of cationic and acid dye fibers for a first predetermined width such as width 21 shown in FIG. 6 which is shown extending in a lateral direction 24 which is perpendicular to direction of feed 14. This occurs at the upper surface 26 of the carpet 12.

Utilizing a continuous dyeing process such as the process 10 shown in FIG. 1 or otherwise, a solution 18 of dye having both acid and cationic dye therein, dyes the carpet 12 with solution 18 wherein the appropriate dye is attached to the appropriate fibers in the first predetermined width. Since there is a relative scarcity of one of the two fibers types at least at the upper surface 26, a relatively larger concentration of that particular dye at that particular location is then left at the first predetermined width. This larger concentration results in that particular dye moving to a location adjacent the first width 21 such as first width, second width 23 where it connects to second receptive fibers of the appropriate type which causes in some environments either a darker strips such as that shown as strips 25 in FIG. 6 and/or a first fade 32 as shown in widths 23 which could be a portion of a larger second width 27 or comprise the entire second width 23 depending on the particular embodiment. Accordingly, at least an edge 23 of the second predetermined width 27 has the effect as shown in FIG. 6. This effect could be an old art dye effect, a darker band 25 and/or a fade 32.

When utilized only system 10 shown in FIG. 1 in the absence of gravity effect or other mechanical effects as shown in FIGS. 2-5, diffusion has been found to be the primary mover from the first width 21 to the second width 23 as shown in FIG. 6.

Further embodiments of FIGS. 2-4 gravity assists in moving the dye into at least an edge of the second predetermined width.

In the embodiment of FIG. 6, the movement in the lateral direction 24 through diffusion has been found to be no more than about five tuft widths and usually about three tuft widths. While utilizing mechanical methods such as those shown in FIGS. 2-5, fade effects such as fourth fade effect 38 can be created over longer distances such as several inches like four, more, or less.

As can be seen in FIG. 2, moving carpet 12 in a non-horizontal manner such as an angle $\alpha$ can assist in moving solution 18 to a desired location so that the appropriate dyes are moved to a second predetermined width in the direction of feed 14. This caused fade 38.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of manufacturing dyed carpet comprising the steps of:

providing a tufted carpet with cationic and acid dyeable fibers, wherein there is a relative majority of a first fiber selected from the group of cationic and acid dyeable fibers for a first predetermined width of yarns at an upper surface of the carpet, said first predetermined width having an adjacent second predetermined width of yarns wherein the first fiber is not a relative majority at the upper surface of the carpet;

utilizing a continuous dying process with a solution of acid and cationic dyes, dying the carpet with at least some of a first dye selected from the group of the acid and cationic dyes in the solution attaching to the relative majority of the first fiber whereby at least some of the acid dye attaches to acid dyeable fibers if acid fibers are the first fiber and at least some of the cationic dye attaches to cationic dyeable fibers if cationic dyeable fibers are the first fiber at the first predetermined width thereby leaving a relatively larger concentration of a second dye of the group of cationic and acid dyes in the first predetermined width whereby at least some of the second dye is at least partially moved laterally to the second predetermined width adjacent the first predetermined width into receptive second fibers of a predetermined affinity of the cationic and acid dyeable fibers thereby providing an old art dye effect at least an edge of the second predetermined width but not over the entire second predetermined width as the concentration of the second dye at least initially decreases moving away from the first predetermined width across the second predetermined width.

2. The method of claim 1 wherein movement of the second dye of the cationic and acid dyes is through at least one of diffusion and gravity.

3. The method of claim 2 wherein the movement occurs in a lateral direction perpendicular to a direction of feed of the carpet through the continuous dying process.

4. The method of claim 3 wherein movement in the lateral direction is confined within no more than five lateral tuft stitches before reestablishing normal concentration of the second dye.

5. The method of claim 2 wherein the movement of the second dye of the cationic and acid dyes is facilitated with a dye applicator applying the solution to the upper surface of the carpet at a dye application point and then moving the carpet in a non-horizontal manner whereby gravity assists in moving the second dye of the cationic and acid dyes to the second predetermined width.

6. The method of claim 5 wherein the movement of the second dye of the cationic dyes to the second predetermined width is in the direction of feed.

7. The method of claim 1 further comprising the step of providing the carpet to a steamer for post treatment.

8. The method of claim 7 wherein the steamer is one of a vertical and a horizontally oriented steamer.

9. The method of claim 1 wherein the old art dye effect further comprises a fade effect.

10. The method of claim 1 wherein the old art dye effect further comprises a darker color at least the edge of the second predetermined width.

11. A method of manufacturing dyed carpet comprising the steps of:

providing a tufted carpet with cationic and acid dyeable fibers, wherein there is a relative majority of a first fiber selected from the group of cationic and acid dyeable fibers for a first predetermined width of yarns at an upper surface of the carpet, said first predetermined width having an adjacent second predetermined width of yarns wherein the first fiber is not a relative majority at the upper side of the carpet;

utilizing a continuous dying process with a solution of acid and cationic dyes, dying the carpet with at least some of a first dye selected from the group of acid and cationic dyes in the solution attaching to the first fibers at the first predetermined width thereby leaving a relatively larger concentration of a second dye of the cationic and acid dyes in the first predetermined width whereby at least some of the second dye is at least partially moved laterally to the second predetermined width adjacent the first predetermined width into receptive second fibers of a predetermined affinity of the cationic and acid dyeable fibers which are not first fibers thereby providing a fade effect at least an edge of the second predetermined width from a darker color to a lighter color through the second fibers across the yarns with at least some of the second predetermined width having the lighter color.

12. The method of claim 11 wherein the movement of the second of the cationic and acid dyes into the second predetermined width provides a linear fade effect.

13. The method of claim 11 wherein the movement of the second of the cationic and acid dyes into the second predetermined width provides a fade darker beginning at a first width and lighter as extends into a second width of the second predetermined width.

14. The method of claim 13 wherein the fade effect further provides a darker color at the edge of the second predetermined width.

15. The method of claim 11 wherein the fade effect is an old art dye effect.

16. The method of claim 11 whereby one of diffusion and mechanical movement move the second of the cationic and acid to the second predetermined width.

17. A method of manufacturing dyed carpet comprising the steps of:

providing a tufted carpet with cationic and acid dyeable fibers, wherein there is a relative majority of a first of cationic and acid dye fibers for a first predetermined width of yarns at an upper surface of the carpet, said first predetermined width adjacent a second predetermined width of yarns wherein the first fiber is not a relative majority of the upper surface of the carpet;

utilizing a continuous dying process with a solution of acid and cationic dyes, dying the carpet with at least some of a first dye selected from the group of the acid and cationic dyes in the solution attaching to the first fiber at the first predetermined width thereby leaving a relatively larger concentration of a second dye of the cationic and acid dyes in the first predetermined width at least some of which is at least partially laterally moved to the second predetermined width into receptive second fibers having a predetermined affinity of the cationic and acid dyes thereby providing a darker color at least an edge of the second predetermined width but not over all of the second predetermined width.

18. The method of claim 17 wherein the movement of at least some of the second of the cationic and acid dyes into the second predetermined width provides a fade effect from darker toward the first predetermined width to lighter as the fade proceeds into the second predetermined width away from the first predetermined width.

19. The method of claim 17 wherein the movement of at least some of the second dye of the cationic and acid dyes into the second predetermined width provides an old art dye effect.

20. The method of claim 17 whereby one of diffusion and mechanical movement move the second of the cationic and acid to the second predetermined width.

* * * * *